US012332030B1

(12) United States Patent
Chen

(10) Patent No.: US 12,332,030 B1
(45) Date of Patent: Jun. 17, 2025

(54) FEEDBACK DEVICE FOR EJECTING ITEMS UPON HITTING TARGET SURFACE

(71) Applicant: Jinxi Chen, Shantou (CN)

(72) Inventor: Jinxi Chen, Shantou (CN)

( * ) Notice: Subject to any disclaimer, the term of this patent is extended or adjusted under 35 U.S.C. 154(b) by 0 days.

(21) Appl. No.: 19/023,255

(22) Filed: Jan. 15, 2025

(30) Foreign Application Priority Data

Dec. 17, 2024 (CN) ..... 202423116630.3

(51) Int. Cl.
*F41J 5/22* (2006.01)
*F41J 3/00* (2006.01)

(52) U.S. Cl.
CPC ..... *F41J 5/22* (2013.01); *F41J 3/0004* (2013.01); *F41J 3/0061* (2013.01)

(58) Field of Classification Search
CPC ..... F41J 5/22; F41J 3/0004; F41J 3/0061
See application file for complete search history.

(56) References Cited

U.S. PATENT DOCUMENTS 2,949,305 A * 8/1960 Davis ..... A63B 63/00 124/16
2009/0174147 A1* 7/2009 Saunders ..... F41J 3/0004 273/392

* cited by examiner

*Primary Examiner* — Jeffrey S Vanderveen
(74) *Attorney, Agent, or Firm* — Nicholas Makridakis

(57) ABSTRACT

A feedback device which ejects items upon hitting target surface is provided, including a target body, a bull's-eye, a flagpole, a first spring, and a second spring. The target body has an installation cavity, and an installation hole is provided at the center of the front face of the target body. The bull's-eye is configured to be telescopically movable within the installation cavity and extends through the installation hole. The flagpole is also configured to be telescopically movable within the installation cavity and extends outward from the target body. The flagpole is detachably connected to the bull's-eye. The first spring is positioned within the installation seat and drives the bull's-eye to extend forward. The second spring is located within the installation cavity and drives the flagpole to extend outward. This allows players to quickly determine whether the bull's-eye has been hit, providing convenience and enhancing enjoyments of shooting games.

9 Claims, 6 Drawing Sheets

FEEDBACK DEVICE FOR EJECTING ITEMS UPON HITTING TARGET SURFACE

CROSS REFERENCE TO RELATED APPLICATION

This application claims priority to Chinese Patent Application No. 2024231166303, filed on Dec. 17, 2024, which is hereby incorporated by reference in its entirety.

TECHNICAL FIELD

The present disclosure relates to the field of target technology, specifically to a feedback device for ejecting items upon hitting target surface.

BACKGROUND

Shooting targets, also known as target markers or targets, are essential tools in shooting sports to determine shooting effectiveness and conduct shooting training. They are typically configured in specific shapes and sizes, with various regions or rings are delineated on them, which usually represent different scoring areas.

Currently, shooting targets are predominantly designed as a monolithic panel structure. When an arrow or dart strikes the target surface, no items are ejected from the targets to provide feedback, making it difficult for users to quickly ascertain whether they have hit the bull's-eye, thus causing inconvenience. Therefore, it is necessary to improve the existing shooting targets.

SUMMARY

In light of the above, the present disclosure aims to address the deficiencies of the existing technologies by providing a feedback device for ejecting items upon hitting target surface, which effectively solves the issues of lack of feedback from existing shooting targets when they are struck.

To achieve the above objectives, the present disclosure adopts the following technical solutions.

In some embodiments of the present disclosure, a feedback device for ejecting items upon hitting target surface is provided, including a target body, a bull's-eye, a flagpole, a first spring, and a second spring. Herein the target body has an installation cavity, and a center of a front face of the target body is provided with an installation hole that communicates with the installation cavity. The bull's-eye is configured to be telescopically movable within the installation cavity and protrudes through the installation hole. The flagpole is configured to be telescopically movable in and out of the installation cavity and extends outside the target body, and the flagpole is detachably connected to the bull's-eye. The first spring is positioned within the installation seat and drives the bull's-eye to extend forward. The second spring is positioned within the installation cavity and drives the flagpole to extend outward.

In some preferred embodiments of the present disclosure, the target body includes a rear shell and a front cover, with the front cover being fixedly connected to the rear shell to form the installation cavity, and the installation hole is located at a center of the front cover's front face.

In some preferred embodiments of the present disclosure, an inner wall of the installation cavity is provided with multiple guiding columns, which are arranged around the bull's-eye with intervals. A peripheral edge of the bull's-eye is provided with multiple guiding holes. The guiding columns insert into the guiding holes, allowing the bull's-eye to move back and forth under a guidance of the guiding columns and guiding holes.

In some preferred embodiments of the present disclosure, an inner wall of the installation cavity is provided with multiple guiding protrusions that extend vertically, and an inner end of the flagpole is recessed with multiple guiding grooves, with the guiding protrusions embedded in the guiding grooves, allowing the flagpole to move up and down under the guidance of the guiding protrusions and grooves.

In some preferred embodiments of the present disclosure, a side edge of the bull's-eye extends to form a hanging piece that extends laterally, and the inner end of the flagpole has a hook portion that can be detachably connected to the hanging piece.

In some preferred embodiments of the present disclosure, there are two hanging pieces symmetrically arranged in pairs. Correspondingly, there are also two hook portions symmetrically arranged in pairs, allowing the two hook portions to be detachably connected to the two hanging pieces.

In some preferred embodiments of the present disclosure, the first spring is a compression spring.

In some preferred embodiments of the present disclosure, the second spring is a tension spring that extends vertically, with its upper and lower ends fixedly connected to the inner top of the target body and the inner end of the flagpole respectively.

In some preferred embodiments of the present disclosure, the upper end of the flagpole has a hanging rod for displaying patterns, which extends above the top of the target body.

Compared with the existing technologies, the present disclosure has significant advantages and beneficial effects. Specifically, it can be known from the aforementioned technical solution:

The bull's-eye is configured in the installation cavity in a telescopically movable manner and exposed in the installation hole, and the flagpole is set in the installation cavity in a manner that the flagpole can telescopically movable in and out of the cavity. When the bull's-eye is struck, the flagpole can automatically and immediately eject, providing feedback. This allows users to quickly determine whether they have hit the bull's-eye, thereby enhancing convenience and increasing the enjoyment of shooting games.

Figure 1:
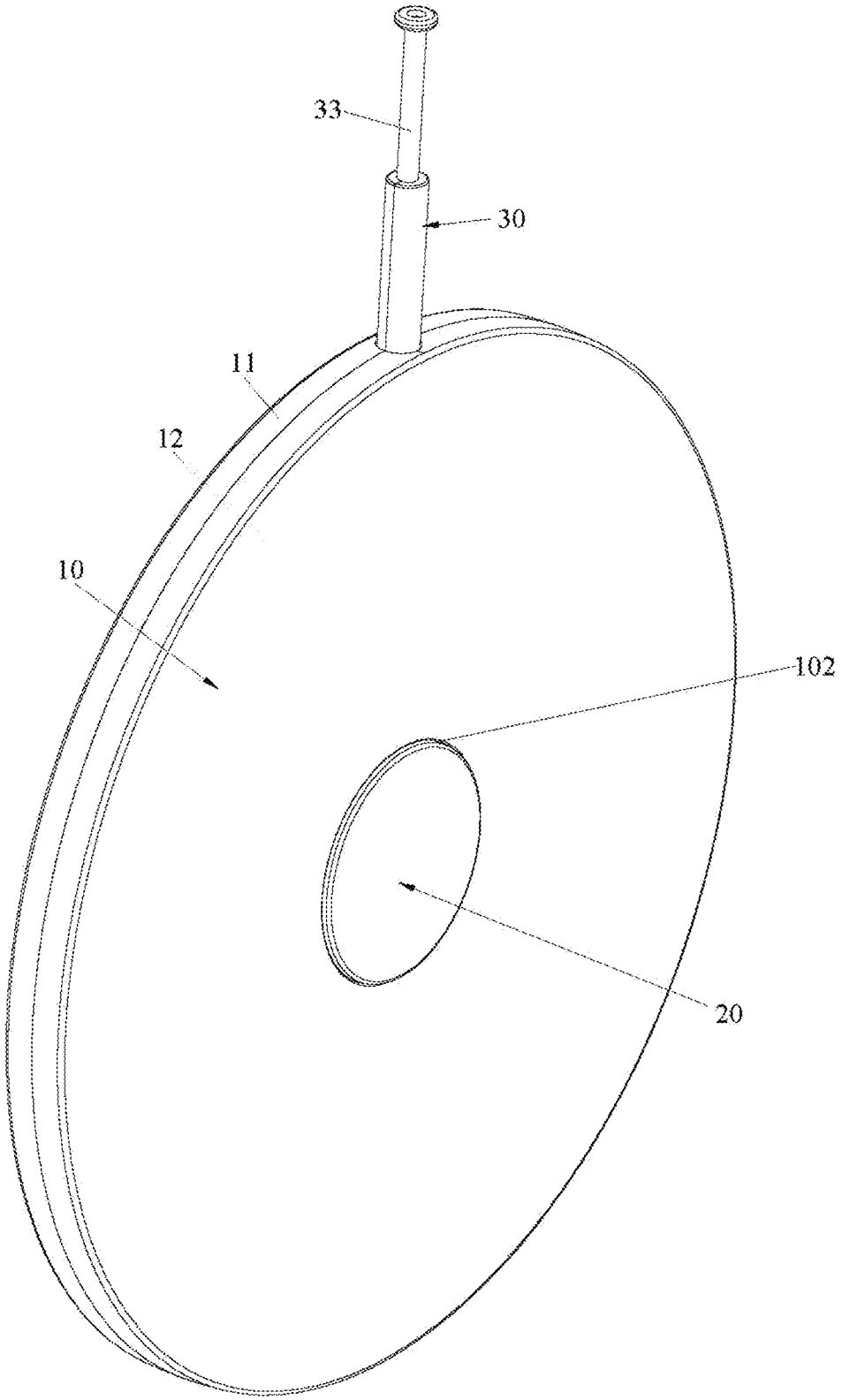
FIG. 1 shows an assembled schematic diagram of a feedback device for ejecting items upon hitting target surface in accordance with some preferred embodiments of the present disclosure.

In the drawings, reference signs are as follows.

| | |
|---|---|
| 10 - Target Body | 11 - Rear Shell |
| 12 - Front Cover | 101 - Installation Cavity |
| 102 - Installation Hole | 103 - Guiding Column |
| 104 - Guiding Protrusion | 20 - Bull's-eye |
| 21 - Guiding Hole | 22 - Hanging Piece |
| 30 - Flagpole | 31 - Guiding Groove |
| 32 - Hook Portion | 33 - Hanging Rod |
| 40 - First Spring | 50 - Second Spring |

DETAILED DESCRIPTION OF THE EMBODIMENTS

Figure 2:
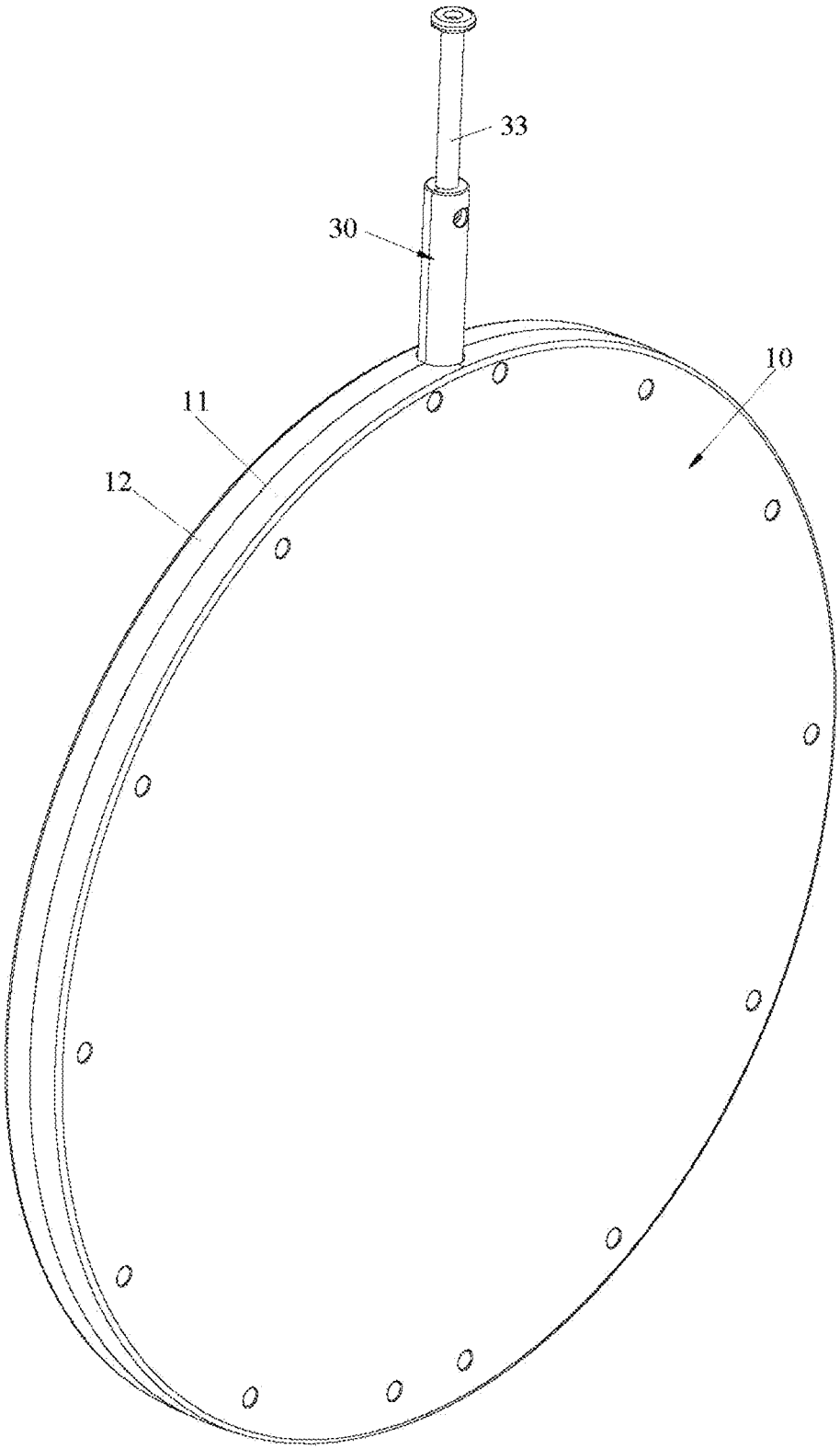
FIG. 2 shows another assembled schematic diagram of the feedback device for ejecting items upon hitting target surface in accordance with some preferred embodiments of the present disclosure.
Figure 3:
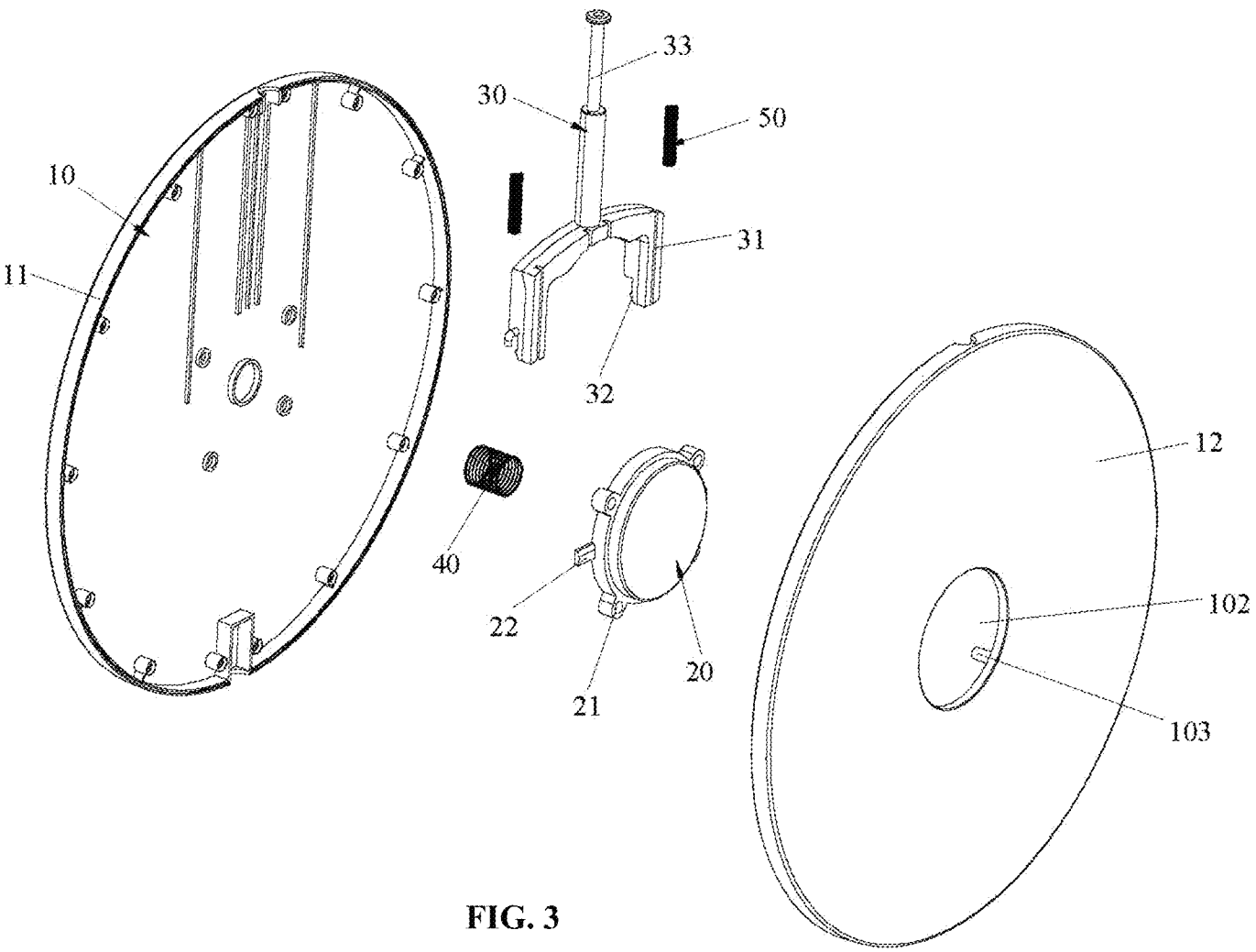
FIG. 3 shows an exploded view of the feedback device for ejecting items upon hitting target surface in accordance with some preferred embodiments of the present disclosure.
Figure 4:
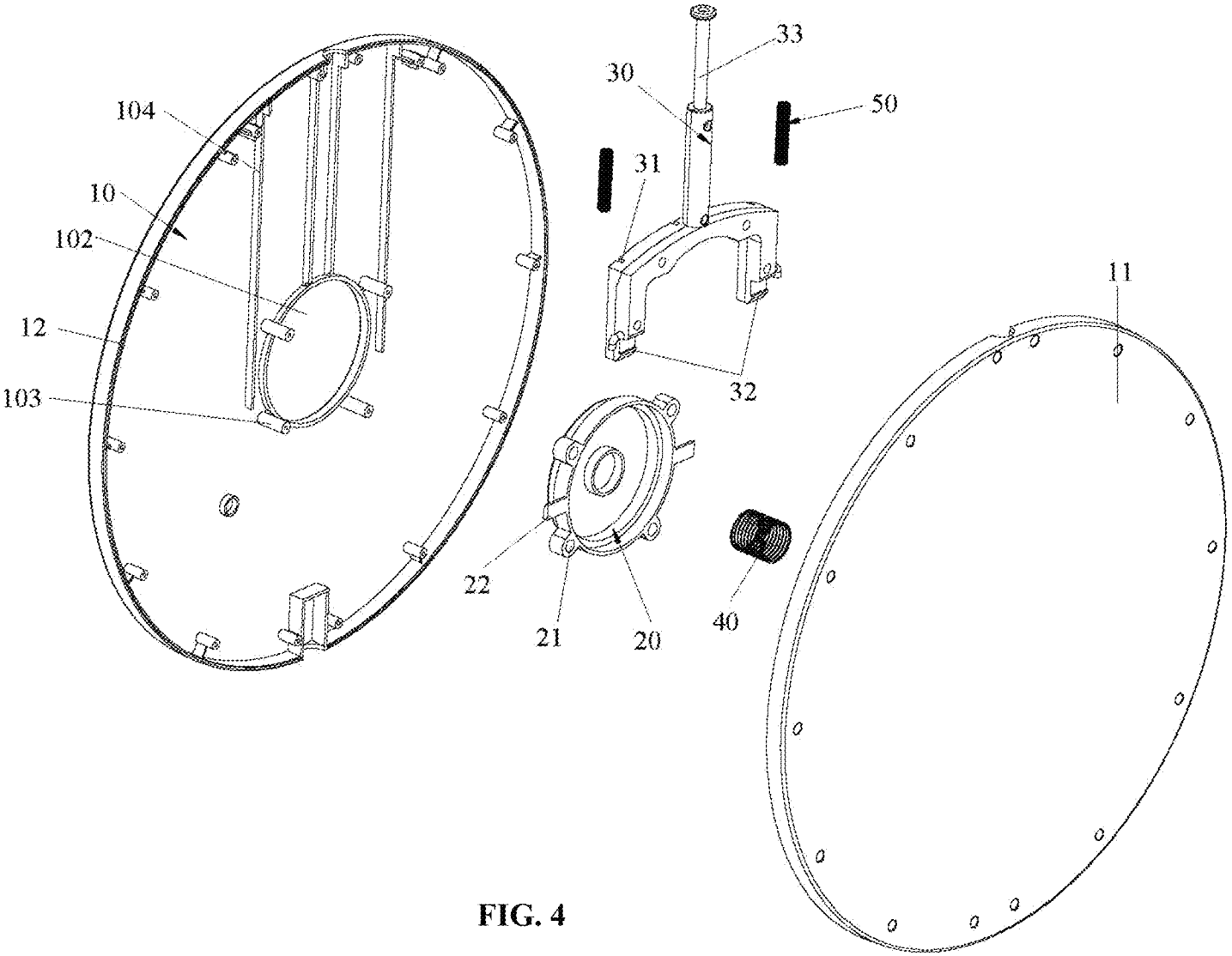
FIG. 4 shows another exploded view of the feedback device for ejecting items upon hitting target surface in accordance with some preferred embodiments of the present disclosure.
Figure 5:
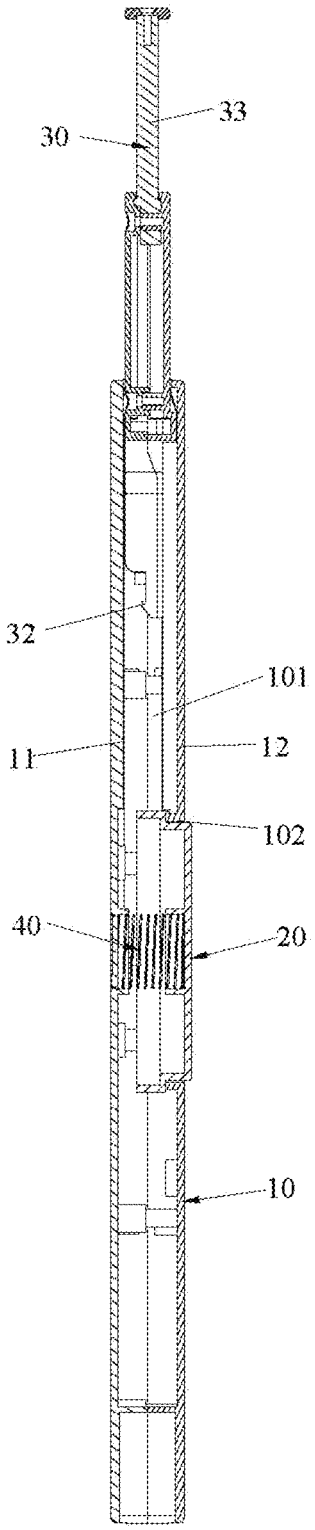
FIG. 5 shows a cross-sectional view of the feedback device for ejecting items upon hitting target surface in accordance with some preferred embodiments of the present disclosure.
Figure 6:
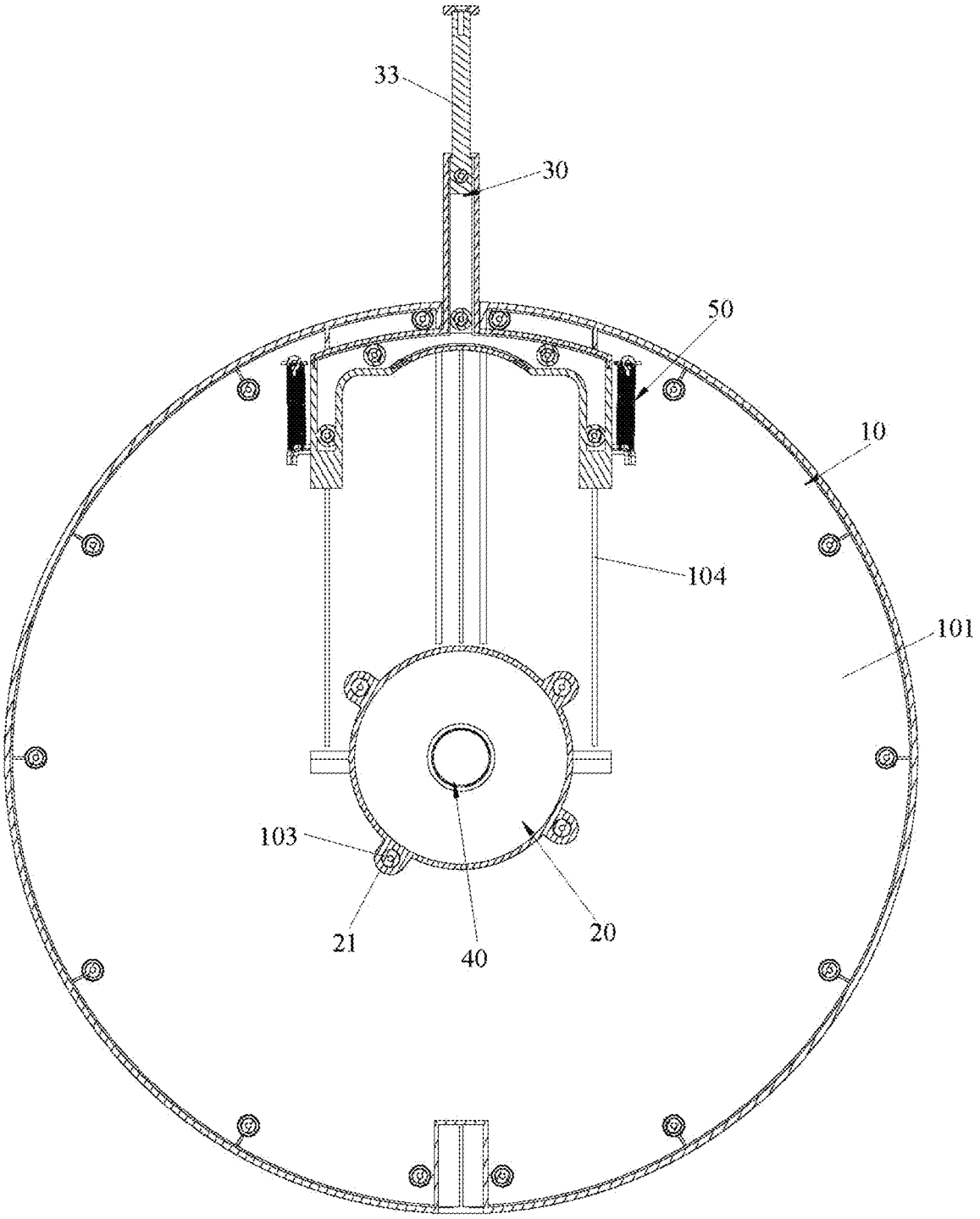
FIG. 6 shows another cross-sectional view of the feedback device for ejecting items upon hitting target surface in accordance with some preferred embodiments of the present disclosure.

Referring to FIGS. 1 to 6, which illustrate a specific structure of a feedback device for ejecting items upon hitting target surface in accordance with some preferred embodiments of the present disclosure, including a target body 10, a bull's-eye 20, a flagpole 30, a first spring 40, and a second spring 50.

The target body 10 has an installation cavity 101, and the center of the front face of the target body 10 is set with an installation hole 102 that communicates with the installation cavity 101. Specifically, the target body 10 is circular and includes a rear shell 11 and a front cover 12. The front cover 12 is fixedly connected to the rear shell 11 to form the installation cavity 101. The installation hole 102 is located at the center of the front face of the front cover 12. Additionally, the inner wall of the installation cavity 101 is provided with multiple guiding columns 103, which are arranged around the bull's-eye 20 at intervals. In some embodiments, the multiple guiding columns 103 are located on the inner side of the front cover 12, with four guiding columns 103 evenly spaced around the inner edge of the installation hole 102. Furthermore, the inner wall of the installation cavity 101 is provided with multiple guiding protrusions 104 that extend vertically, with these guiding protrusions 104 extending out from the inner side of the front cover 12.

The bull's-eye 20 is configured to be telescopically movable back and forth within the mounting cavity 101 and is exposed in the installation hole 102. In some embodiments, the peripheral edge of the bull's-eye 20 is provided with multiple guiding holes 21, into which multiple guiding columns 103 are respectively inserted. The bull's-eye 20 is guided to move back and forth under the cooperation of the guiding columns 103 and the guiding holes 21, ensuring smooth telescopic movement of the bull's-eye 20. Additionally, the side edge of the bull's-eye 20 extends outward to form a hanging piece 22, which extends laterally. There are actually two hanging pieces 22 that are symmetrically arranged.

The flagpole 30 is configured to be telescopically movable in and out within the installation cavity 101 and extends outward from the target body 10. The flagpole 30 is detachably connected to the bull's-eye 20. In some embodiments, the inner end of the flagpole 30 is recessed to form multiple guiding grooves 31, into which multiple guiding protrusions 104 are respectively embedded. The flagpole 30 moves up and down under the guidance of the guiding protrusions 104 and the guiding grooves 31, ensuring very smooth and reliable telescopic movement of the flagpole 30. Furthermore, the inner end of the flagpole 30 has a hook portion 32, which is detachably connected to the hanging piece 22. There are also two symmetrically arranged hook portions 32. The two hook portions 32 can be detachably connected to the two hanging pieces 22. In addition, the upper end of the flagpole 30 is equipped with a hanging rod 33 for displaying patterns, which extends upward beyond the top of the target body 10.

The first spring 40 is installed in the installation seat 101 and drives the bull's-eye 20 to extend forward. In some embodiments, the first spring 40 is a compression spring.

The second spring 50 is installed in the installation cavity 101 and drives the flagpole 30 to extend outward. In some embodiments, the second spring 50 is a tension spring, which extends vertically, with its upper and lower ends fixedly connected to the inner top of the target body 10 and the inner end of the flagpole 30 respectively.

The method of using the feedback device for ejecting items upon hitting target surface of the present disclosure is described in detail as follows.

During shooting activities, when the bull's-eye 20 is struck by an arrow, dart, or the like, the bull's-eye 20 first retracts backward and then extends forward under the action of the first spring 40. During the retraction of the bull's-eye 20, the hook portion 32 on the flagpole 30 detaches from the hanging piece 22 on the bull's-eye 20. Then, under the action of the second spring 50, the flagpole 30 extends outward from the target body 10, thereby achieving a feedback action of the item being ejected upon hitting the target surface. Subsequently, the flagpole 30 is compressed back into the target body 10, and once it is in position, the hook portion 32 on the flagpole 30 engages with the hanging piece 22 on the bull's-eye 20, allowing for the next shooting activity.

The feedback device for ejecting items upon hitting target surface of the present disclosure is designed focus on that, by configuring the bull's-eye to be telescopically movable back and forth within the mounting cavity and be exposed in the installation hole, and by configuring the flagpole to be telescopically movable in and out within the installation cavity, the flagpole can automatically pop out immediately after the bull's-eye is hit, achieving a feedback action. This allows the player to quickly determine whether the bull's-eye has been hit, thereby providing convenience and enhancing the enjoyment of shooting games.

The technical principles of the feedback device for ejecting items upon hitting target surface of the present disclosure have been described in conjunction with specific embodiments. These descriptions are intended solely to explain the principles of the present disclosure and should not be construed in any way as limiting the scope of protection of the present invention. Based on the explanations provided herein, those skilled in the art can conceive of other specific embodiments of the present disclosure without requiring inventive effort, and these embodiments shall fall within the scope of protection of the present invention.

What is claimed is:

1. A feedback device for ejecting items upon hitting target surface, comprising a target body, a bull's-eye, a flagpole, a first spring, and a second spring;

wherein the target body comprises an installation cavity, an installation hole is centrally located on a front face of the target body and communicates with the installation cavity;

wherein the bull's-eye is configured to be telescopically movable within the installation cavity and protrudes through the installation hole;

wherein the flagpole is configured to be telescopically movable in and out of the installation cavity and extend outside the target body, and the flagpole is detachably connected to the bull's-eye;

wherein the first spring is positioned within the installation seat and drives the bull's-eye to extend forward; and wherein the second spring is positioned within the installation cavity and drives the flagpole to extend outward.

2. The feedback device for ejecting items upon hitting target surface according to claim 1, wherein the target body comprises a rear shell and a front cover, the front cover is fixedly assembled with the rear shell to form the installation cavity, and the installation hole is located at a center of a front face of the front cover.

3. The feedback device for ejecting items upon hitting a target surface according to claim 1, wherein an inner wall of the installation cavity is convexly provided with multiple guiding columns arranged around the bull's-eye with intervals, a periphery of the bull's-eye is provided with multiple guiding holes inserted into the guiding holes respectively, and the bull's-eye is configured to move telescopically back and forth under a guidance of the guiding columns and guiding holes.

4. The feedback device for ejecting items upon hitting target surface according to claim 1, wherein an inner wall of the installation cavity is convexly provided with multiple guiding protrusions extending vertically, an inner side of the flagpole is concavely provided with multiple guiding grooves embedded in the guiding grooves, and the flagpole is configured to move telescopically up and down under a guidance of the guiding protrusions and guiding grooves.

5. The feedback device for ejecting items upon hitting target surface according to claim 1, wherein a side edge of the bull's-eye extends to form a hanging piece and the hanging piece extends laterally; an inner end of the flagpole has a hook portion, and the hook portion is detachably connected to the hanging piece.

6. The feedback device for ejecting items upon hitting target surface according to claim 5, wherein there are two hanging pieces symmetrically arranged in pairs, and correspondingly, there are also two hook portions symmetrically arranged in pairs, and the two hook portions is configured to be detachably connected to the two hanging pieces.

7. The feedback device for ejecting items upon hitting target surface according to claim 1, wherein the first spring is a compression spring.

8. The feedback device for ejecting items upon hitting target surface according to claim 1, wherein the second spring is a tension spring extending vertically, both ends of the tension spring is fixedly connected to an inner top of the target body and an inner end of the flagpole respectively.

9. The feedback device for ejecting items upon hitting target surface according to claim 1, wherein an upper end of the flagpole has a hanging rod for displaying patterns, and the hanging rod extends upward to a top of the target body.

* * * * *